United States Patent [19]

Romblom et al.

[11] 4,364,351

[45] Dec. 21, 1982

[54] DIESEL ENGINE FUEL LIMITING SYSTEM

[75] Inventors: Edward R. Romblom, DeWitt; Arthur R. Sundeen, Lansing, both of Mich.

[73] Assignee: General Motors Corporation, Detroit, Mich.

[21] Appl. No.: 264,690

[22] Filed: May 18, 1981

[51] Int. Cl.[3] ..... F02M 59/20

[52] U.S. Cl. ..... 123/357; 123/358

[58] Field of Search ..... 123/357, 358, 359, 367, 123/395, 399, 400

[56] References Cited

U.S. PATENT DOCUMENTS

| | | | |
|---|---|---|---|
| 3,744,461 | 7/1973 | Davis | 123/357 |
| 3,867,918 | 2/1975 | Williams et al. | 123/357 |
| 3,978,837 | 9/1976 | Lundberg | 123/357 |
| 4,174,694 | 11/1979 | Wessel et al. | 123/357 |
| 4,223,654 | 9/1980 | Wessel et al. | 123/358 |

FOREIGN PATENT DOCUMENTS

| | | | |
|---|---|---|---|
| 54-8222 | 1/1979 | Japan | 123/358 |

*Primary Examiner*—Charles J. Myhre
*Assistant Examiner*—Magdalen Moy
*Attorney, Agent, or Firm*—Howard N. Conkey

[57] ABSTRACT

The position of a limit stop member which limits the mechanical position of a fuel metering valve in a diesel engine fuel injection pump is open loop controlled to a position offset from a desired fuel metering valve limit position by an amount in the increased fuel direction that is equal to the maximum possible error in the open loop controlled positional relationship between the limit stop and the fuel metering valve. The position of the fuel metering valve is sensed and compared with the maximum desired metering valve limit and when the fuel metering valve position exceeds the limit position, the position of the limit stop is closed loop adjusted to the maximum fuel metering valve position.

3 Claims, 2 Drawing Figures

DIESEL ENGINE FUEL LIMITING SYSTEM

Figure 1:
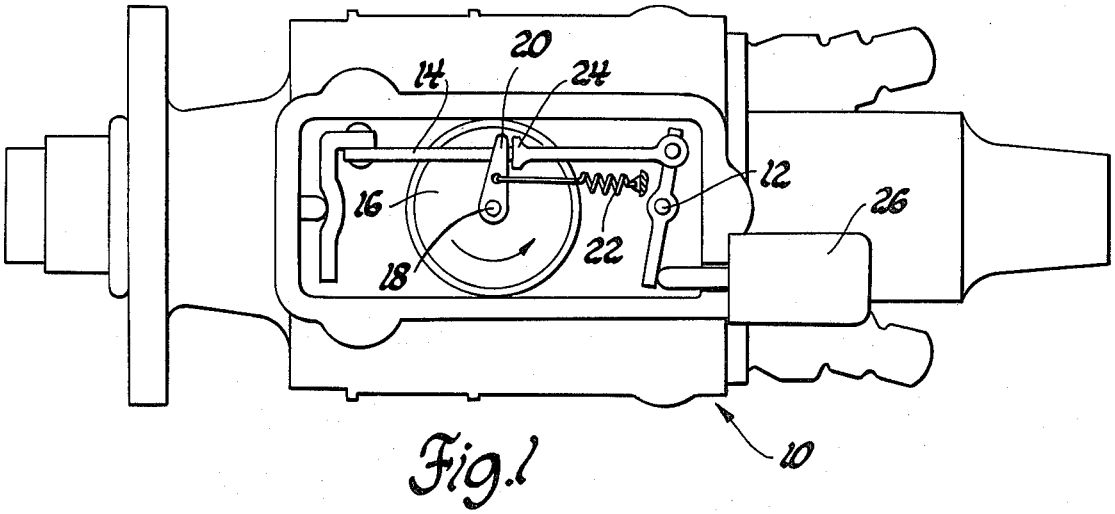

This invention relates to the control of fuel flow to a diesel engine. Specifically, this invention is directed toward a system for limiting the maximum fuel quantity supplied to a diesel engine.

It is known in diesel engine fuel control systems to limit the quantity of fuel supplied to the engine by an injection pump to a predetermined maximum amount in accord with engine operating parameters that may include, for example, engine speed and barometric pressure. Typical of these known systems, a signal is generated in accord with engine operating conditions representing the maximum fuel quantity to be admitted to the diesel engine in terms of the position of a movable stop member which limits the mechanical travel of a fuel control element in the fuel injection pump. This signal is then utilized to position the movable stop member to limit the mechanical travel of the fuel control element. To precisely control the position of the movable stop member to the scheduled fuel limit position, the signal representing the maximum fuel quantity to be admitted to the engine is compared with the output of a position indicator attached to the movable stop member. A closed loop circuit corrects the position of the stop member until the error between the position of the stop member and the maximum fuel quantity signal is zero. The fuel metering element is then limited in the fuel increasing position at the position at which it engages the stop member. While this type of system may accurately position the stop member at the position represented by the maximum fuel quantity signal, errors in the limited position of the fuel control element may still occur as a result of assembly and manufacturing tolerances and controller errors. These errors may result in varying positional relationships between the stop member and the fuel metering element. Closed loop adjustment of the position of the stop member by monitoring its own position and comparing it to a commanded position does not correct for these positional variances.

It is the general object of this invention to provide an improved fuel limiting system for a diesel engine injection pump that accurately limits the position of the fuel control element by a movable stop member independent of varying relationships between the stop member positions and the corresponding limited positions of the fuel metering element.

It is another object of this invention to provide a system for limiting the maximum fuel quantity admitted to a diesel engine by a fuel injection pump by controlling the position of a variable position stop which limits the mechanical travel of a fuel control element in accord with the difference between the measured position of the fuel control element and a desired limit position of the fuel control element.

It is another object of this invention to provide for a system for limiting the maximum quantity of fuel admitted to a diesel engine by a fuel injection pump by positioning a movable stop member, which limits the travel of a fuel control element, when the open loop position of the fuel control element is less than the maximum allowable fuel control element position and by closed loop positioning the stop member when the position of the fuel control element is greater than the maximum allowable fuel control element.

Figure 2:
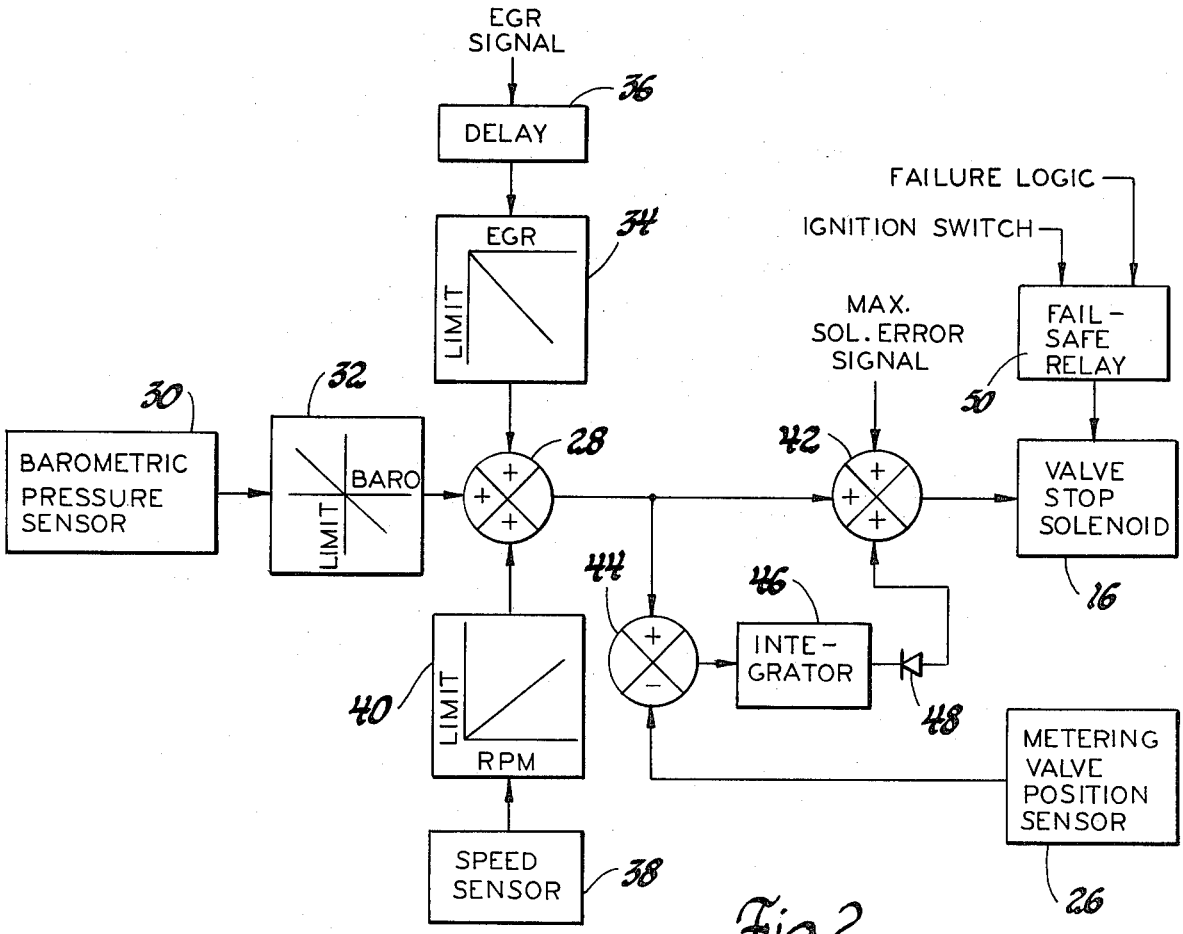

These and other objects of this invention may be best understood by reference to the following description of a preferred embodiment and the drawings in which:

FIG. 1 is a diagram of a fuel injection pump including a fuel metering valve and a variable position limit stop for limiting the position of the fuel metering valve in the fuel increasing direction; and FIG. 2 is a diagram of the maximum fuel limiting system for limiting the position of a fuel metering valve in the fuel increasing direction in accord with the principles of this invention.

Referring to FIG. 1, there is illustrated a conventional diesel engine fuel injection pump generally designated 10 that includes a fuel metering valve element 12 that is rotated by a conventional governor via a governor linkage 14 to control the quantity of fuel admitted to a diesel engine with each injection event. The linkage 14 is adjusted by means of a conventional centrifugal governor which positions the linkage 14 in accord with engine speed and a manually positioned throttle lever. The quantity of fuel admitted with each injection event is dependent on the angular position of the fuel metering valve 12. Rotation of the fuel metering valve 12 in a counterclockwise direction provides for increasing quantities of fuel admitted to the engine.

To provide for the limiting of the quantity of fuel admitted to the engine, a rotary solenoid 16 is provided having an output shaft 18 upon which a limit stop element 20 is secured for rotation therewith. The stop element 20 is biased against rotation in a counterclockwise direction by means of a spring 22 tending to bias the stop element 20 in a clockwise direction. The maximum angular position of the fuel metering valve 12 in the fuel increasing direction is limited to a position at which a cooperating element 24 on the governor linkage 14 engages the limit stop member 20. To variably adjust the maximum allowable fuel admitted to the engine as a function of engine operating parameters, the position of the limit stop 20 is controlled by variably energizing the rotary solenoid 16. With a given value of current through the rotary solenoid 16, the stop element 20 is rotated until the rotating force of the solenoid 16 is exactly offset by the return force of the spring 22 to provide for a position at which the fuel metering valve 12 is limited in the fuel increasing direction.

As will be described relative to FIG. 2, the position of the limit stop 20 is controlled by monitoring the position of the fuel metering valve 12. In this respect, a position sensing potentiometer 26 monitors the rotation of the fuel metering valve 12 and provides a signal representing the angular position of the fuel metering element 12 and accordingly the fuel quantity being admitted to the engine with each injection event.

As a result of manufacturing and assembly tolerances and other system variances, for a given level of energization of the rotary solenoid 16 for positioning the limit stop 20, the fuel admitted to the engine when the metering valve is at the limited position may differ from the desired limited amount represented by the level of energization of the rotary solenoid 16. In accord with the principles of this invention, the fuel limit system limits the position of the fuel metering valve 12 in the fuel increasing direction to the desired value determined by the engine operating parameters independent of varying positional relationships between the limit stop 20 and the fuel metering valve 12.

Referring to FIG. 2, the fuel limit controller for adjusting the position of the limit stop 20 in accord with the principles of this invention is illustrated. In general, when the fuel metering valve angle is less than the maximum allowable angle at the current engine operating condition (the fuel admitted to the engine being less than the maximum allowable amount), the rotary solenoid 16 is energized open loop to position the limit stop 20 to a limit position that is offset from the desired limit position in the fuel increasing direction by an amount that is at least equal to or greater than the maximum anticipated open loop error in the positional relationships between the limit stop 20 and the corresponding limited position of the fuel metering valve 12, taking into consideration variations due to manufacturing tolerances. When the metering valve angular position exceeds the maximum allowable position in the fuel increasing direction, the rotary solenoid 16 is then energized closed loop to eliminate the error between the maximum and actual metering valve positions to limit the metering valve position at the maximum allowable position.

A signal representing the position of the fuel metering valve 12 at which the maximum allowable fuel is admitted to the engine is provided at the output of a summer 28 as a function of predetermined engine operating parameters. In this embodiment, the fuel quantity admitted to the engine is limited as a function of the barometric pressure, the exhaust gas recirculated (EGR) to the engine and the engine speed. A barometric pressure sensor 30 provides a signal representing the value of barometric pressure to a function generator 32 which provides a signal representing a limited fuel quantity component represented by barometric pressure. This signal is applied to one input of the summer 28. A signal representing the amount of EGR is provided to a function generator 34 through a delay circuit 36. The function generator 34 provides a signal to a second input of the summer 28 representing a limited fuel quantity component represented by EGR. In the same manner, an engine speed sensor 38 supplies a signal representing engine speed to a function generator 40 which provides a signal representing a limited fuel quantity component represented by engine speed to a third input of the summer 28.

The summed signal representing the angular position of the fuel metering valve 12 at which the maximum allowable quantity of fuel is admitted to the engine is supplied to an input of a summer 42 whose output energizes the rotary solenoid 16 which rotates the limit stop 20 to a position determined by the magnitude of the signal at the output of the summer 42. A signal representing the maximum anticipated error in the open loop positional relationships between the limit stop 20 and the fuel metering valve 12 is supplied to a second input of the summer 42. The resulting signal supplied to the rotary solenoid 16 causes the limit stop 20 to be rotated to a position that is greater than the position determined by the output signal from the summer 28 in the fuel increasing direction by an amount determined by the magnitude of the maximum solenoid error signal applied to the summer 42.

The output of the metering valve angular position sensor 26 is compared with the maximum allowable angular position of the fuel metering valve 26 represented by the output signal from the summer 28. In this respect, the signal output of the sensor 26 is supplied to a negative input of a summer 44 which receives the signal representing the maximum allowable angular position at a positive input. The difference between the actual and maximum allowable angular positions of the fuel metering valve 12 is applied to the input of an integrator 46 whose output is applied to a positive input of the summer 42 through a diode 48. The diode 48 is poled so as to pass only negative signals from the integrator 46 to the positive input of the summer 42. As a result of the diode 48, as long as the metering valve position represented by the output of the sensor 26 is less than the maximum allowable position, the output of the integrator 46 is positive resulting in no signal being applied to the corresponding input of the summer 42. Accordingly, as long as this condition exists, the limit stop 20 is positioned open loop to the position represented by the output of the summer 28 offset in the fuel increasing direction by an amount represented by the maximum solenoid error signal applied to the summer 42. Therefore, while the metering valve angular position is less than the maximum allowable position, the stop 20 is maintained substantially at the required limit position.

When the metering valve position is increased in accord with engine operation by the governor linkage 14 to a position exceeding the maximum allowable position represented by the output of the summer 28, the input to the integrator 46 becomes negative causing the integrator 46 to integrate in the negative direction. When the output of the integrator 46 becomes negative, the diode 48 conducts and the signal input to the rotary solenoid 16 from the summer 42 is decreased causing the limit stop 20 to be rotated in a fuel decreasing direction until it engages the cooperating stop element 24 on the governor linkage 14 and thereafter rotated to move the fuel metering valve 12 in the fuel decreasing direction until its position is equal to the maximum allowable position represented by the output of the summer 28. When this condition exists, the error input to the integrator 46 is reduced to zero so that the output of the integrator 46 remains at a constant negative value. The energization of the rotary solenoid 16 is therefore maintained constant so that the position of the limit stop 20 is maintained at the position that limits the fuel metering valve 12 at the maximum allowable angular position. Since the rotary solenoid 16 is controlled in closed loop fashion as a function of the position of the metering valve 12, the limited position of the fuel metering valve 12 is controlled to the desired position independent of any variations in the positional relationships between the limit stop 20 and the fuel metering valve 12 to more accurately limit the maximum fuel quantity admitted to the diesel engine.

By providing open loop positioning of the limit stop 20, the time required for the closed loop control to position the limit stop 20 when the fuel metering valve position exceeds the maximum allowable position is minimized. However, it is understood that the position of the limit stop 20 may be controlled close loop at all positions of the fuel metering valve 12. However, during those times when the metering valve position is less than the maximum allowable position, the limit stop 20 will be rotated to its maximum position in the fuel increasing direction thereby requiring a greater movement to provide for fuel limiting when the metering valve position exceeds the maximum allowable position.

To ensure that adequate fuel can be provided for engine starting and during failure modes, a fail-safe relay 50 is provided which is energized by actuation of the ignition switch to the start position and by the output of a failure logic circuit detecting a failure mode.

Energization of the relay 50 functions to energize the rotary solenoid 16 so that it is positioned in its maximum limit position in the fuel increasing direction.

While the invention is described with reference to an injection pump having a fuel metering valve rotated to control fuel, the invention is equally applicable to other injection pumps such as those having a linearly movable fuel control rack and limit stop.

The foregoing description of a preferred embodiment for the purpose of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. A system for limiting the maximum fuel quantity admitted to a diesel engine comprising, in combination:

a variable position fuel metering element for controlling the fuel quantity admitted to the engine;

means effective to position the fuel metering element in accord with predetermined engine operating parameters;

a variable position stop effective to limit the position of the fuel control metering element in the fuel increasing direction;

means effective to generate a fuel limit signal representing a maximum allowable position of the fuel control metering element corresponding to a maximum allowable fuel quantity to be admitted to the engine;

means effective to generate a position signal representing the position of the fuel control metering element and therefore the actual fuel quantity admitted to the engine; and control means effective to position the stop in accord with the difference between the maximum allowable position of the fuel control metering element represented by the fuel limit signal and the actual position of the fuel control metering element represented by the position signal, whereby when the fuel metering element is moved to the maximum allowable position, the stop is moved by the control means to a position to limit the position of the fuel metering element at the maximum allowable position independent of differing relationships between stop positions and the corresponding limited positions of the fuel metering element.

2. A system for limiting the maximum fuel quantity admitted to a diesel engine comprising, in combination:

a variable position fuel metering element for controlling the fuel quantity admitted to the engine;

means effective to position the fuel metering element in accord with predetermined engine operating parameters;

a variable position stop effective to limit the position of the fuel control metering element in the fuel increasing direction;

means effective to generate a fuel limit signal representing the position of the fuel control metering element corresponding to a maximum allowable fuel quantity to be admitted to the engine;

means effective to generate a maximum error signal representing the maximum possible error in the positional relationships between the stop positions and the corresponding limited positions of the fuel metering element;

means effective to generate a position signal representing the position of the fuel control metering element and therefore the actual fuel quantity admitted to the engine;

open loop control means effective when the position of the fuel control metering element represented by the position signal is less than the maximum allowable position represented by the fuel limit signal, to position the stop in accord with the sum of the fuel limit signal and the maximum error signal, the stop being positioned open loop to a position whereat the limited position of the fuel metering element is at least greater than the maximum allowable position represented by the fuel limit signal; and closed loop control means effective when the position of the fuel metering element represented by the position signal is greater than the maximum allowable position represented by the fuel limit signal to position the stop in accord with the difference between the maximum allowable position of the fuel control metering element represented by the fuel limit signal and the actual position of the fuel control metering element represented by the position signal, whereby when the fuel metering element is moved to the maximum allowable position, the stop is moved by the control means from an open loop position to a closed loop position to limit the position of the fuel metering element at the maximum allowable position independent of differing relationships between stop positions and the corresponding limited positions of the fuel metering element.

3. A system for limiting the maximum fuel quantity admitted to a diesel engine comprising, in combination:

a variable position fuel metering element for controlling the fuel quantity admitted to the engine;

means effective to position the fuel metering element in accord with predetermined engine operating parameters;

a variable position stop effective to limit the position of the fuel control metering element in the fuel increasing direction;

means effective to generate a fuel limit signal representing a maximum allowable position of the fuel control metering element corresponding to a maximum allowable fuel quantity to be admitted to the engine;

means effective to bias the fuel limit signal in the increased fuel limit direction by an amount equal to the maximum anticipated variance between the stop positions and the corresponding desired limited positions of the fuel metering element;

open loop control means effective when the position of the fuel metering element is less than the maximum allowable position represented by the fuel limit signal to position the stop in accord with the biased fuel limit signal; and closed loop control means effective when the position of the fuel control element is greater than the maximum allowable position represented by the fuel limit signal to position the stop in accord with the difference between the maximum allowable position of the fuel control metering element represented by the fuel limit signal and the actual position of the fuel control metering element, whereby when the fuel metering element is moved to the maximum allowable position, the stop is moved from an open loop position to the closed loop position to limit the fuel metering element at the maximum allowable position independent of the differing relationships between stop positions and the corresponding limited positions of the fuel metering element.

* * * * *